United States Patent [19]

McGraw

[11] 4,141,178

[45] Feb. 27, 1979

[54] SOLAR OPERATED TOY APPARATUS

[76] Inventor: Betty McGraw, 1619 Debeney Dr., Houston, Tex. 77039

[21] Appl. No.: 818,954

[22] Filed: Jul. 25, 1977

[51] Int. Cl.[2] ..... A63H 29/00

[52] U.S. Cl. ..... 46/201; 46/206

[58] Field of Search ..... 46/1 R, 201, 202, 206

[56] References Cited

U.S. PATENT DOCUMENTS 1,964,843 12/1934 Schoenfeld ..... 46/206

*Primary Examiner*—Louis G. Mancene
*Assistant Examiner*—Robert F. Cutting
*Attorney, Agent, or Firm*—Robert D. Farkas

[57] ABSTRACT

A solar operated toy apparatus includes a transparent housing having a circularly shaped lens on the upper surface thereof adapted to focus the sun's rays into a reservoir area therebeneath. The housing is provided with centrally disposed apertures on the upper surface thereof and apertures in the bottom surface thereof to control the flow of warm air currents. A plurality of vanes are disposed horizontally and affixed to a vertical shaft which is coupled to the drive wheels rotatably affixed to the housing. The toy apparatus does not require any batteries for operation and is propelled by the rising air currents flowing therethrough.

6 Claims, 3 Drawing Figures

SOLAR OPERATED TOY APPARATUS

BACKGROUND OF THE INVENTION

1. Field of the Invention

This invention relates to toys and, more particularly, to a solar powered toy apparatus requiring no external source of energy.

2. Description of the Prior Art

The prior art abounds with solar powered devices and machines which may be used for measuring light energy and are capable of performing work. These devices utilize the sun's rays to boil water or other fluid creating steam. The steam thus obtained is used to turn the turbine and may provide thereby mechanical or electrical energy.

A typical example of a apparatus for indicating the intensity of light radiation is U.S. Pat. No. 182,172 issued to Crookes on Sept. 12, 1876. This device measures the radiation of light by causing vanes to rotate when hit directly by the sun's rays or, alternatively, causing deflection which can be measured on a scale. A similar apparatus is disclosed in U.S. Pat. No. 1,000,831 issued to Martin on Aug. 15, 1911. This apparatus is also used to measure light radiation. A motor operated by solar heat energy is disclosed in U.S. Pat. No. 1,785,651 issued to Romagnoli on Dec. 16, 1930. This apparatus is rather expensive and complicated and uses the fact that the sun's rays focus into a particular area and cause water to boil thereby providing steam to run a steam engine or motor.

The prior art has numerous other devices which attempt to utilize the energy given off by the sun to perform work. However, very little attempt has been made to use the sun's rays to develop a toy which will amuse children of all ages and require no external source of energy to operate.

SUMMARY OF THE INVENTION

Therefore, a primary object of the present invention is to provide a solar operated toy.

Another object of the present invention is to provide a solar operated toy which is inexpensive to manufacture and requires a minimum of parts.

Still another object of the present invention is to provide a reliable solar powered toy which may operate without the use of conventional batteries.

Still another object of the present invention is to provide a solar operated toy which will amuse children of all ages and in doing so will impart knowledge of the basic laws of physics.

These objects as well as further objects and advantages of the present invention will become readily apparent after reading the description of a non-limiting illustrative embodiment and the accompanying drawing.

A solar operated toy apparatus, according to the principles of the present invention, comprises in combination; a housing having the top portion thereof provided with a plurality of random apertures centrally disposed thereon. The housing is provided with a circularly shaped lens circumscribing the apertures, with the lens being formed to receive the sun's rays and focus them to an area therebeneath. Additionally included is a reservoir means having heat retaining material disposed therein positioned in the area for receiving the sun's rays. The reservoir is toroidally shaped and affixed to a portion of the housing. A vertically disposed shaft extends through the center aperture of the toroidally shaped reservoir and vane means are affixed to the shaft on the upper end thereof. Wheel means are rotatably affixed to the bottom portion of the housing for moving the housing on a flat surface. Gear means are operatively coupled to the lower end of the vertical shaft of the wheel means for converting the rotary motion of the vane means caused by rising hot air currents to rotary motion of the wheel means, thereby moving the housing on the flat surface.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
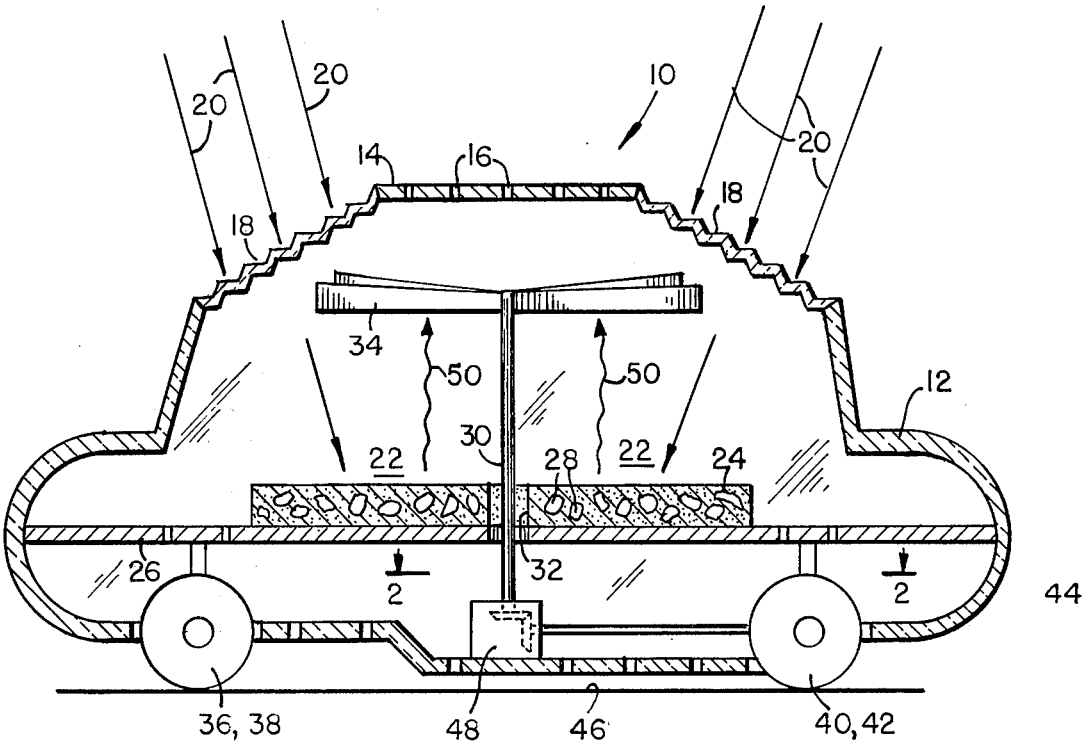
FIG. 1 is a pictorial representation partially in cross-section of a solar operated toy apparatus, according to the principles of the present invention.
Figure 3:
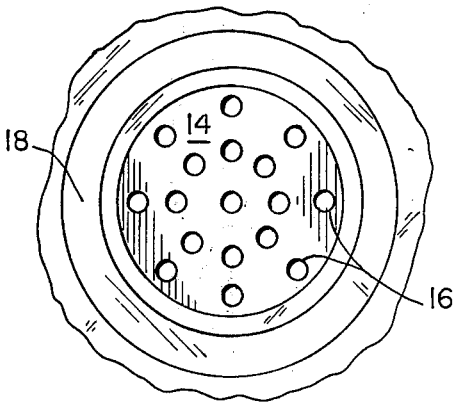
FIG. 3 is a partial view of the top portion of the housing.
Figure 2:
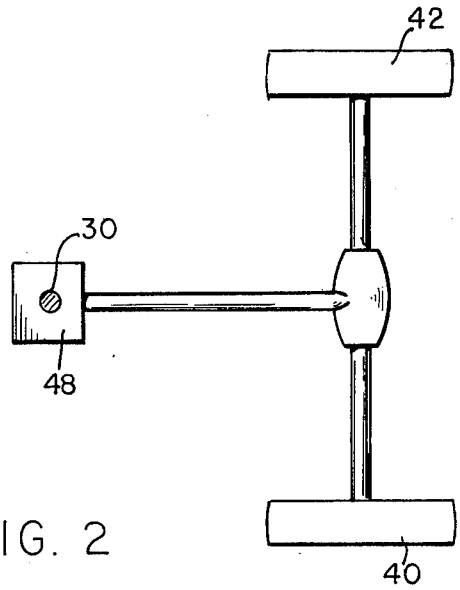
FIG. 2 is a view taken along the line 2—2 of FIG. 1.

Referring to the FIGS. 1, 2 and 3, and more particularly, to FIG. 1 which shows a cross-sectional view of the solar operated toy apparatus 10 which includes a housing 12 with a top portion 14 provided with a plurality of random apertures centrally disposed thereon. The housing is provided with a circularly shaped lens configuration 18 which circumscribes the apertures 16. The lens 18 is formed to receive the sun's rays 20 and focus them to an area 22 therebeneath. A reservoir 24, which is toroidally shaped and affixed to the housing 12 on a shelf portion 26 provided therefor. A heat retaining material 28 is disposed within the reservoir means 24 and may be of crushed lava, or any suitable material adapted to receive and be heated by the sun's rays and retain it for prolonged periods of time.

A shaft 30 is disposed vertically and extends through the center aperture 32 of the toroid 24. A plurality of vanes 34 are affixed to the upper portion of the shaft 30 in a conventional manner.

In the preferred embodiment of the invention the housing 12 is provided with four wheels 36, 38, 40 and 42 of which only two are shown in FIG. 1. The wheels 36, 38, 40, and 42 are rotatably affixed to the bottom portion 44 of the housing 12 and permit the housing 12 to be moved along on a flat surface 46.

A conventional right angle gear 48 is affixed to the lower portion of shaft 30 and is operatively coupled between the lower portion of shaft 30 and the wheels 40 and 42. Thus, the rotary motion of the vane 34 which is caused by rising hot air currents 50 to rotary motion of the wheels 40 and 42, thereby moving the housing 12 along the flat surface 46 without the use of any external source of energy other than the sun's rays.

Therefore, a primary advantage of the present invention is to provide a solar operated toy.

Another advantage of the present invention is to provide a solar operated toy which is inexpensive to manufacture and requires a minimum of parts.

Still another advantage of the present invention is to provide a reliable solar powered toy which may operate without the use of conventional batteries.

Still another advantage of the present invention is to provide a solar operated toy which will amuse children of all ages and in doing so will impart knowledge of the basic laws of physics.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention what is claimed is:

1. A solar operated toy apparatus comprising, in combination:

a housing having the top portion thereof provided with a plurality of random apertures centrally disposed therein, said housing being provided with a circularly shaped lens circumscribing said apertures, said lens being formed to receive the sun's rays and focus them to an area therebeneath;

reservoir means having heat retaining material disposed therein positioned in said area for receiving said sun's rays, said reservoir being toroidally shaped and affixed to a portion of said housing;

a vertically disposed shaft extending through the center aperture of said toroidally shaped reservoir means;

vane means being affixed to said shaft on the upper end thereof;

wheel means rotatably affixed to the bottom portion of said housing for moving said housing on a flat surface;

gear means operatively coupled between the lower end of said vertical shaft and said wheel means for connecting the rotary motion of said vane means caused by rising hot air currents to rotary motion of said wheel means, thereby moving said housing on said flat surface.

2. A solar operated toy apparatus according to claim 1 whereby said wheel means includes wheels for movement in a horizontal plane for causing said housing to move in a circle.

3. A solar operated toy apparatus according to claim 1 whereby said housing is transparent.

4. A solar operated toy apparatus according to claim 1 whereby said heat retaining material is crushed lava stone.

5. A solar operated toy apparatus according to claim 1 whereby said gear means includes a gear box operatively connected to the lower end of said shaft and an output shaft at right angle thereto, said output shaft being operatively coupled to a universal gear box disposed on an axle between a pair of wheels affixed thereon, said wheels being rotatably affixed to the bottom portion of said housing.

6. A solar operated toy apparatus according to claim 1 wherein said housing is further provided with a plurality of apertures on the bottom portion thereof for controlling the flow of air currents from the bottom thereof past said vane means and out the top thereof.

* * * * *